United States Patent [19]

Zerbe

[11] Patent Number: 4,488,383

[45] Date of Patent: Dec. 18, 1984

[54] APPARATUS FOR SUPPORTING PORTABLE HAND TOOLS

[76] Inventor: Lowell B. Zerbe, 317 Sunset Dr., Columbus, Ind. 47201

[21] Appl. No.: 510,820

[22] Filed: Jul. 5, 1983

Related U.S. Application Data

[63] Continuation-in-part of Ser. No. 232,399, Feb. 9, 1981, Pat. No. 4,403,457.

[51] Int. Cl.[3] ..... B24B 23/02

[52] U.S. Cl. ..... 51/170 T; 144/134 D; 144/136 C

[58] Field of Search ..... 51/166 R, 166 TS, 170 T, 51/241 R, 170 R, 177, 180; 144/1 E, 1 F, 134 D, 136 C, 119 R; 409/182

[56] References Cited

U.S. PATENT DOCUMENTS 1,653,108 12/1927 Koenig ..... 51/170 T
4,403,457 9/1983 Zerbe ..... 51/170 T

FOREIGN PATENT DOCUMENTS 1189405 3/1965 Fed. Rep. of Germany .... 51/170 T
1162796 8/1969 United Kingdom ..... 144/136 C

*Primary Examiner*—Roscoe V. Parker
*Attorney, Agent, or Firm*—Barnes & Thornburg

[57] ABSTRACT

A portable hand tool, such as a drill, having an outer casing and a chuck adapted to receive a sander attachment is supported to facilitate handling of the tool. An apparatus for supporting the tool includes a base member having an opening for receiving the sander attachment, a guide member spanning the base opening also including an opening for receiving the chuck, a clamping member for engaging and supporting the rotary tool on the base member so that the sander attachment is received in the opening in the base member, and springs between the clamping member and the base member. The springs bias the clamping member with respect to the base member so that the sander attachment is forced against a work surface through the opening in the base member.

8 Claims, 10 Drawing Figures

APPARATUS FOR SUPPORTING PORTABLE HAND TOOLS

This is a continuation-in-part of my co-pending U.S. patent application Ser. No. 232,399, filed Feb. 9, 1981 and now U.S. Pat. No. 4,403,457.

The present invention relates to attachments for portable hand tools which facilitate the handling of the tool and is more particularly concerned with an improved apparatus for supporting the hand tool which is versatile and easy to attach when converting the tool to other uses.

Portable hand tools are generally designed for a particular use. For example, a portable drill is designed for boring holes into wood, metal, or other materials. Because of the similarities of the structure and operation of many hand tools, a portable drill may come equipped with a bit fitted with a sanding pad to allow the drill to be used as a sander. However, in converting a power drill to a sander, a problem occurs in trying to hold the drill while performing the sanding operation. The sanding pad has substantially greater surface are which creates substantial friction with the work surface. This friction creates a greater amount of torque on the drill housing than when the drill is used to bore holes. Because of the handle design of the drill, this greater torque may jerk the drill from the user's grasp. Furthermore, it is difficult to maintain constant pressure on the entire surface of the sanding pad to achieve a constant sanding pattern on the work surface.

Some previous efforts have been made to provide attachments for portable power-driven tools or machines to facilitate the handling, control, and positioning of the tool when converted from its conventional use to another use. For example, U.S. Pat. No. 1,882,705 discloses a support or handle for portable power-driven tools or machines which are designed for rubbing, polishing, sanding, and the like. U.S. Pat. Nos. 3,162,221 and 3,762,452 disclose attachments for converting a portable power-driven drill for use as a router.

The present invention includes improvements to the support attachment disclosed in my previous application, Ser. No. 232,399, filed Feb. 9, 1981. In converting a portable power-driven drill to a sander, a support attachment permitting too much downward force on the sanding pad can result in uneven or gouged finishes. Further, the attachment should permit the user to force the sanding pad flat against the working surface. In some instances, it is desirable to use the sander to prepare working surfaces which are adjacent to other surfaces extending at right angles thereto. In such situations, the corner between the working surface and right angle surface adjacent thereto cannot be reached because of the attachment.

The present invention provides an improved apparatus which is inexpensive and simple to attach to a portable tool for use as a sander.

Another object of the present invention is to provide an apparatus for supporting a portable tool for use as a sander which is adaptable to various-sized tools and which can be easily and quickly attached to and removed from the tools.

A further object is to provide an apparatus for supporting a portable tool which is lightweight and which includes handles to facilitate control and positioning of the tool during operation as a sander.

Yet another object of the present invention is to provide an apparatus for supporting a portable sanding tool which allows the relationship of the sanding pad with respect to the base of the apparatus to be varied.

It is a further objective to provide an apparatus for supporting a portable sanding tool which limits the force that can be applied to the sanding pad by the user.

An additional objective is to provide an apparatus for supporting a portable sanding tool which permits use of the sander on surfaces abutting right-angled surfaces, such as the surface of a wall next to a floor.

Various other features and advantages of the present invention will become apparent in view of the following detailed description of embodiments thereof, which description should be considered in conjunction with the accompanying drawings, in which.

Figure 1:
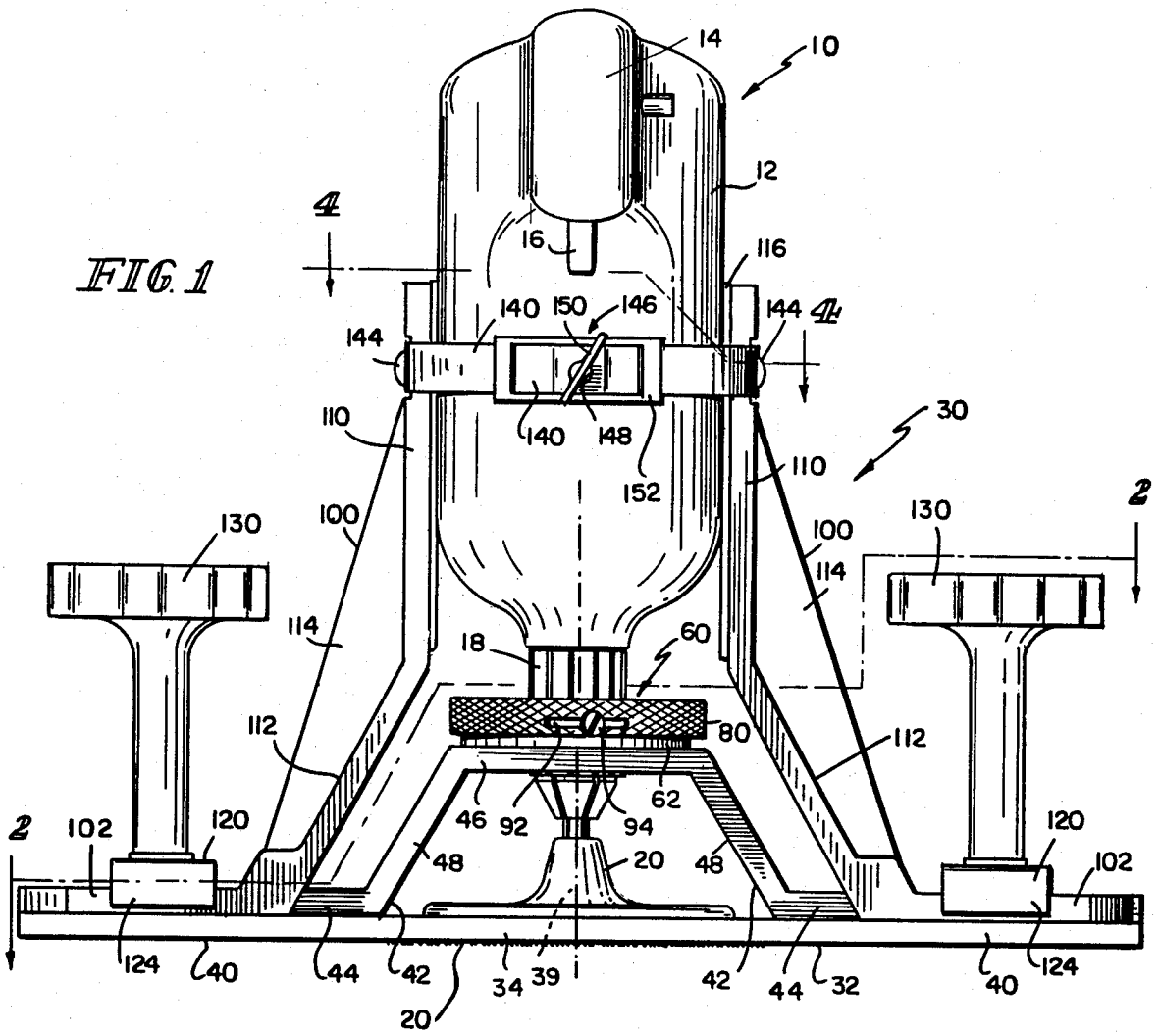
FIG. 1 is a side elevational view of an apparatus according to the present invention shown supporting a power-driven portable drill.

Referring now to FIG. 1, the present invention is shown attached to a portable power-driven tool 10, such as a portable drill, having a generally cylindrical outer casing 12 and a handle or grip 14 extending radially outwardly from the casing 12. A conventional trigger switch 16 is shown in a normal position relative to the casing 12 and handle 14. The distal end of the casing 12 includes an offset axially extending chuck 18 adaptable for holding a tool attachment 20, such as the bit of a drill or sanding pad. While the present invention is described in relation to a portable drill 10 having a sanding pad 20 attached to the chuck 18, it can be appreciated that the invention may be adapted to various other power-driven portable tools of various sizes having features similar to the drill 10.

Figure 2:
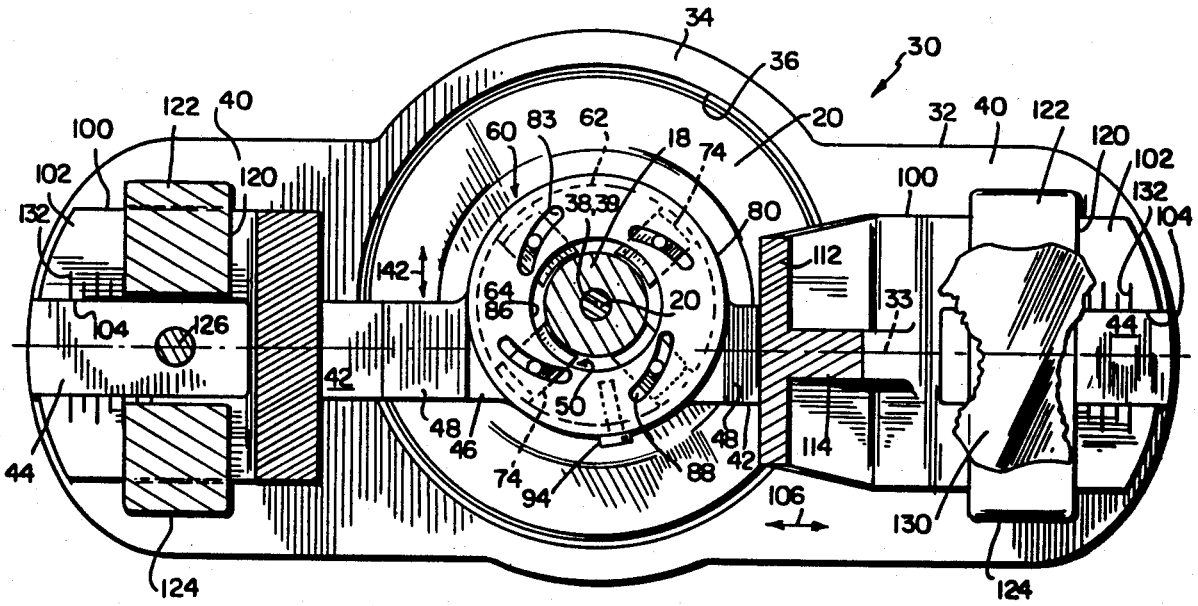
FIG. 2 is a transverse view, partly cross-sectioned and partly broken away, of the apparatus shown in FIG. 1, taken generally along section lines 2—2 in FIG. 1.

Referring to FIGS. 1 and 2, the apparatus 30 of the present invention is designed to support the portable tool 10 at generally a right angle to a work surface (not shown). The apparatus 30 includes an elongated, substantially planar base member 32 having a central longitudinal axis 33 (FIG. 2). Base 32 may be constructed of wood, metal, or other rigid materials. The base member 32 includes a central section 34 having generally arcuate outer edges. A circular opening 36 is formed in the central section 34 and has a center 38 located on a central axis 39 (FIG. 1) of the opening 36. As best shown in FIG. 2, the central axis 39 of opening 36 is laterally located in spaced relationship to the longitudinal axis 33 of the base member 32. This relationship of the central axis 39 of the opening 36 and the longitudinal axis 33 of the base member 32 is provided to compensate for the offset position of the chuck 18 of the drill 10. In a preferred embodiment, the opening 36 has a diameter of 5.5 inches (13.97 cm) which will accommodate the pad of a standard sander attachment 20.

The base member 32 also includes two generally rectangular outer sections 40 which extend outwardly from the central section 34 in opposed directions. An elongated guide member 42 is permanently mounted to the base member 32 on the central longitudinal axis 33 of the base member 32. The guide member 42 includes two narrow track sections 44 which are secured to the rectangular outer sections 40 of the base member 32. A bridge section 46 is elevated in spaced relationship above the opening 36 by intermediate sections 48 which extend angularly upwardly from the track sections 44. Bridge section 46 spans the opening 36 and includes a circular opening 50 which is concentric to opening 36. Opening 50 has a diameter which is generally less than the diameter of the opening 36, and provides a guide for the chuck 18 of the drill 10. The center of opening 50 is also located on the central axis 39 of the opening 36 in the base member 32.

Figure 3:
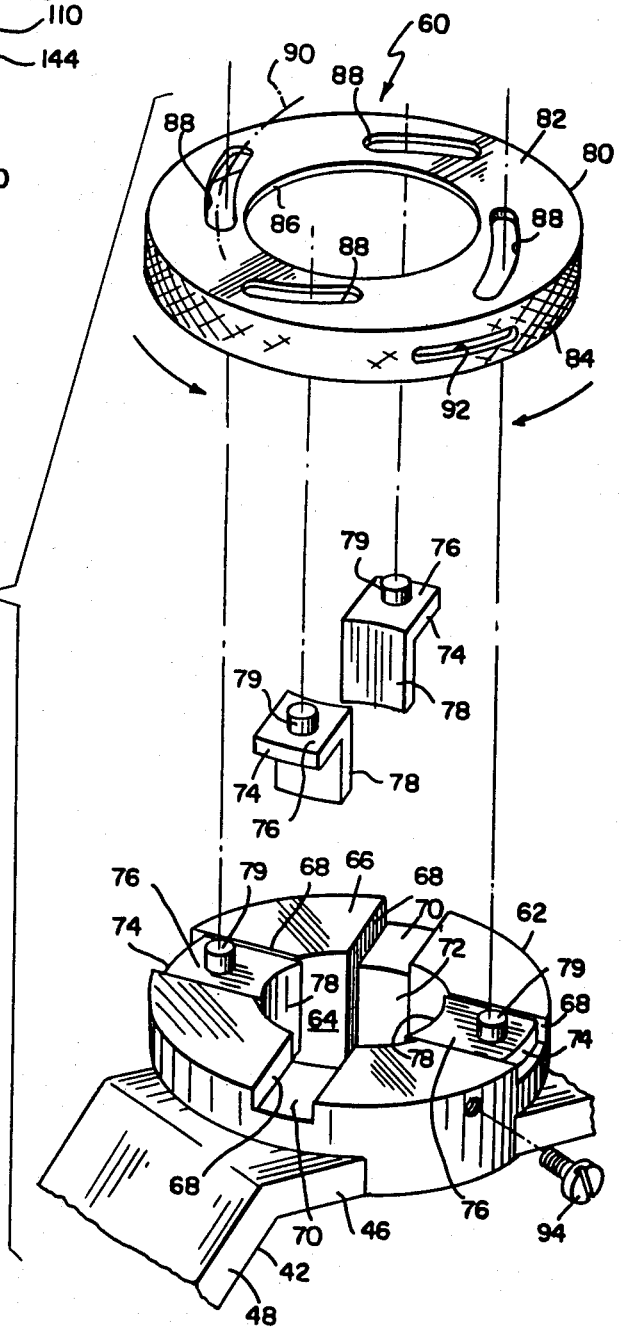
FIG. 3 is an exploded perspective view of a section of the apparatus shown in FIG. 1.

Referring particularly to FIG. 3, an adjustable bushing 60 is mounted to the bridge section 46 of the guide member 42 for varying the size of the opening 50 to adapt the apparatus 30 to drills 10 having various-sized chucks 18. In the preferred embodiment, the bushing 60 is adjustable for chucks 18 of standard $\frac{1}{4}$ inch (0.635 cm) and $\frac{3}{8}$ inch (0.953 cm) drills 10. The bushing 60 includes a cylindrical base 62 which may be constructed of metal. Base 62 is mounted to the bridge section 46 of the guide member 42 adjacent the opening 50. A circular opening 64 is formed in the base 62 and, when mounted to the bridge section 46, the opening 64 is concentric with the openings 36, 50 so that the center of opening 64 is located on the central axis 39 of the opening 36. Opening 64 has a diameter which is either equal to or less than the diameter of the opening 50.

The base 62 of the bushing 60 includes four equidistant radially spaced grooves 68. Each groove 68 includes a radially extending portion 70 formed in the top surface 66 of the base 62 and an axially extending arcuate portion 72 formed in the axially extending surface of the opening 64. The axially extending portions 72 of the grooves 68 have a curved shape which generally corresponds to an arc of the circular opening 64.

Four radially adjustable fingers 74 are slidably received in the grooves 68. Each finger 74 is generally L-shaped in cross section and includes a radially extending portion 76 corresponding to the radially extending portion 70 of grooves 68 and an axially extending arcuate portion 78 corresponding to the axially extending arcuate portion 72 of the grooves 68. A boss 79 projects upwardly from each of the fingers 74 and is employed to move the fingers 74 radially inwardly and outwardly relative to the central axis 39 of the opening 36.

Continuing to refer to FIG. 3, a circular adjustment plate 80 having an outer diameter slightly greater than the outer diameter of the cylindrical base 62 is rotatably received on the base 62. The adjustment plate 80 has a top surface 82 and a circumferential skirt 84 depending downwardly around the periphery of the top surface 82. As shown in FIG. 3, the skirt 84 is knurled to provide a grip for rotation of the plate 80 on the base 62. The plate 80 further includes a central circular opening 86 so that when plate 80 is received on base 62, the opening 86 is concentric to openings 36, 50, and 64. Therefore, opening 86 also has its center located on the central axis 39 of the opening 36. Opening 86 has a diameter which is generally the same as the diameter of opening 64 of the base 62.

Four inwardly curving slots 88 are formed in the top surface 82 of the adjustment plate 80 for slidably receiving the bosses 79 which project upwardly from the fingers 74. Each inwardly curving slot 88 is struck along an arc 90 of a circle which is eccentric to the circular openings 36, 50, 64, and 86. A slot 92 is also formed circumferentially in the downwardly depending skirt 84 for receiving an adjustment screw 94 which is threaded through the slot 92 into the base 62.

In operation of the bushing 60, the adjustment plate 80 is rotated in a clockwise direction, as indicated by the arrow in FIG. 3, to simultaneously move fingers 74 radially inward toward the center of the opening 64 in the base 62 to reduce the size of opening 64 and the corresponding opening 50 in the bridge section 46 of the guide member 42. Plate 80 is rotated in a counterclockwise direction, as indicated by the arrow in FIG. 3, to simultaneously move the fingers 74 radially outward away from the center of the opening 64 to enlarge the opening 64 and the corresponding opening 50 in the bridge section 46 of the guide member 42. Once the desired size for opening 50 has been determined by the bushing 60 so that chuck 18 is freely rotatable within the openings 50 and 64, adjustment screw 94 is tightened to secure the adjustment plate 80 in position in order to maintain the radial position of the fingers 74. Fingers 74 restrict lateral movement of the chuck 18 during the operation of the drill 10.

Returning to FIGS. 1 and 2, two support brackets 100 are movably carried in opposed relationship on the base member 32, and each includes a generally planar channel section 102. Each channel section 102 includes a channel 104 for slidably engaging a track section 44 of the guide member 42. Track sections 44 guide the movement of support brackets 100 in directions toward and away from openings 36, 50, as indicated by the arrow 106 in FIG. 2, along the longitudinal axis 33 of the base member 32.

Each support bracket 100 includes an upwardly extending arm 110 for engaging the outer casing 12 of the drill 10. Each arm 110 is connected to a channel section 102 by an intermediate section 112 which extends angularly upwardly from the channel section 102. The arm 110 and the channel section 102 are also interconnected by a reinforcing brace 114 to increase the strength and rigidity of the arm 110. As most particularly shown in FIG. 4, the inner surface of each of the arms 110 is covered by a strip of pliable material 116, such as rubber, for engaging the outer casing 12 of the drill 10.

Continuing to refer to FIGS. 1 and 2, movable support brackets 110 are secured in selected positions relative to the track sections 44 of the guide member 42 by C-clamps 120. Each C-clamp 120 has a generally rectangular portion 122 and flanges 124 depending downwardly from the ends of the rectangular portion 122 for engaging the channel sections 102 of the brackets 100. Mounting screws 126 project upwardly through the base member 32 and each of the track sections 44 of the guide member 42. The rectangular portions 122 of the C-clamps 120 include an aperture (not shown) for receiving the mounting screws 126. Handles or knobs 130 are threaded onto the mounting screws 126 and tightened against the C-clamps 120 to secure the channel sections 102 of the support brackets 100 to the base member 32. Calibrated adjustment scales 132 may be provided on either the channel sections 102 or the track sections 44 adjacent the channels 104 in order to assure that the support brackets 100 are symmetrically positioned on the base member 32 relative to the central axis 39 of the opening 36.

Figure 4:
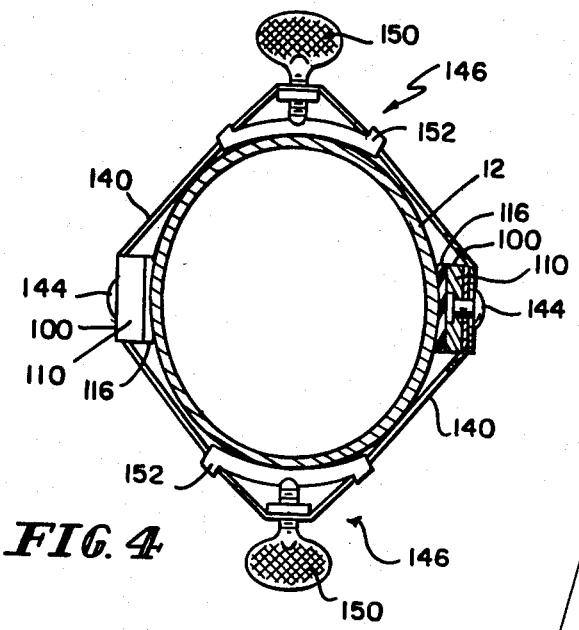
FIG. 4 is a transverse view, partly cross-sectioned, of the apparatus shown in FIG. 1, taken generally along section lines 4—4 in FIG. 1.

Referring to FIGS. 1 and 4, two adjustable bands 140 are connected to the arms 110 of the support brackets 100 in opposed relationship to clamp the two arms 110 into engagement with the outer casing 12 of the drill 10 and to further prevent movement of the drill 10 in the directions of the arrow 142 in FIG. 2. Bands 140 may be connected to the arms 110 by conventional means 144 such as screws or rivets.

Referring more particularly to FIG. 4, each band 140 includes an adjustment member 146 for adjusting the lengths of the bands 140 to tighten and loosen engagement with the casing 12. Each adjustment member 146 includes a threaded aperture 148 formed in the band 140 and an adjustment screw 150 threadably received in the aperture 148. Each band 140 is threaded through a buckle 152 which engages the casing 12 and which further serves as a surface for engaging the screws 150 to tighten the band 140.

As can be appreciated from the illustrative embodiment, the apparatus 30 can be easily attached to and removed from the drill 10 using only a screw driver. The drill 10 is inserted axially between the bands 140 and positioned so that the bottom of the sander attachment 20 projects slightly beyond the bottom of the base member 32 and further so that the axis of the bit of the sander attachment 20 is generally aligned with the central axis 39 of the opening 36. By adjusting the bushing 60, the size of the opening 50 of the guide member 42 is increased or decreased so that the fingers 74 are in close proximity to the chuck 18 to prevent lateral movement of the chuck 18 during the operation of the drill 10. Once the bushing 60 has been adjusted, the adjustment screw 94 is tightened with the screw driver to fix the radial position of the fingers 74 and the size of the openings 50 and 64. Further positioning and engagement of the casing 12 is accomplished by turning the adjustment screws 150 provided on the bands 140 to tighten or loosen each band 140. With the drill 10 supported in the apparatus 30, the user can control and position the drill relative to a work surface (not shown) by grasping the handles 130. Handles 130 give the user two points of control in place of the single control handle 14 provided on the outer casing 12 of the drill 10.

Figure 5:
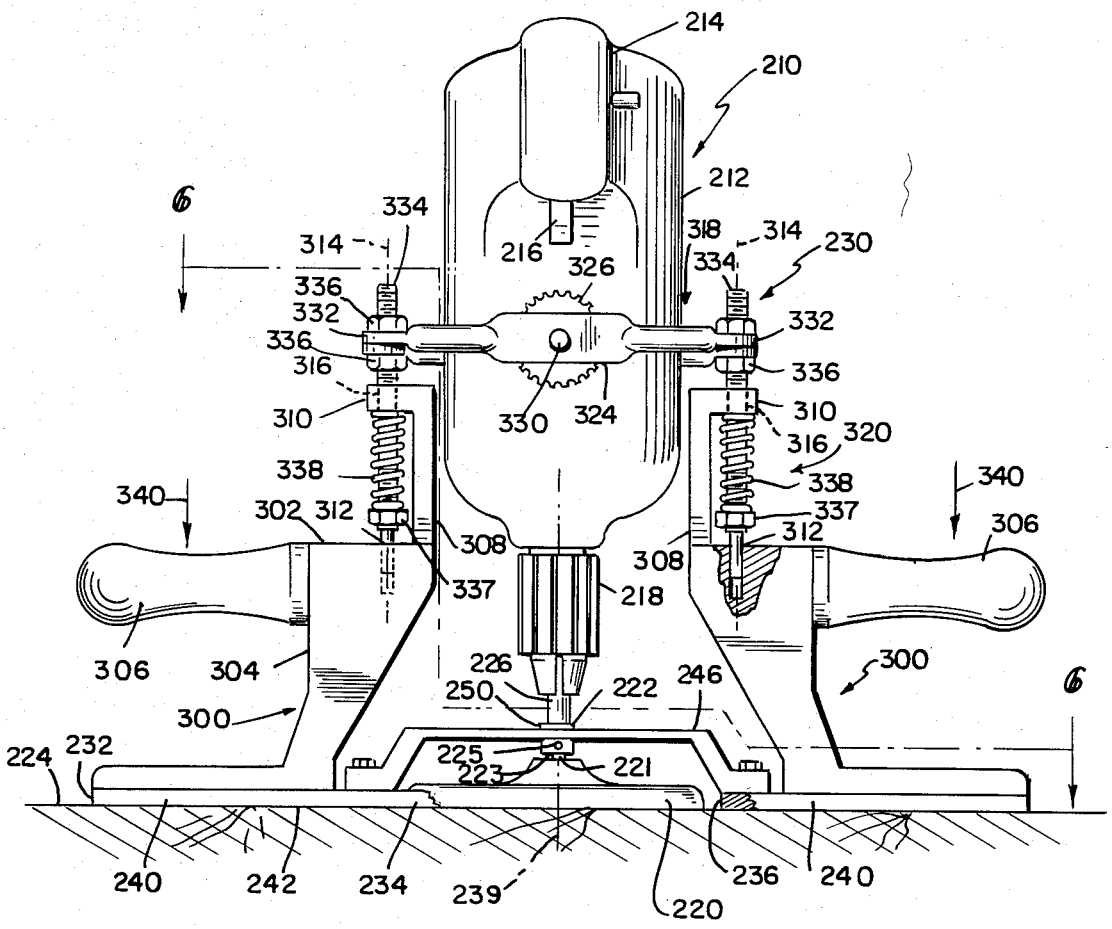
FIG. 5 is a side elevational view of another embodiment of an apparatus constructed in accordance with the present invention.

Referring now to FIG. 5, another embodiment of the present invention is shown attached to a portable power-driven tool 210, such as a portable drill, having a generally cylindrical outer casing 212 and a handle or grip 214 extending radially outwardly from the casing 212. A conventional trigger switch 216 is shown in a normal position relative to the casing 212 and handle 214. The distal end of the casing 212 includes an offset axially extending chuck 218 adaptable for holding an adapter 222 for holding a tool attachment 220, such as the bit of a drill or sanding pad. While the present invention is described in relation to a portable drill 210 having a sanding pad 220 attached to the adapter 222 held by the chuck 218, it can be appreciated that the invention may be adapted to various other power-driven portable tools of various sizes having features similar to the drill 210.

Figure 6:
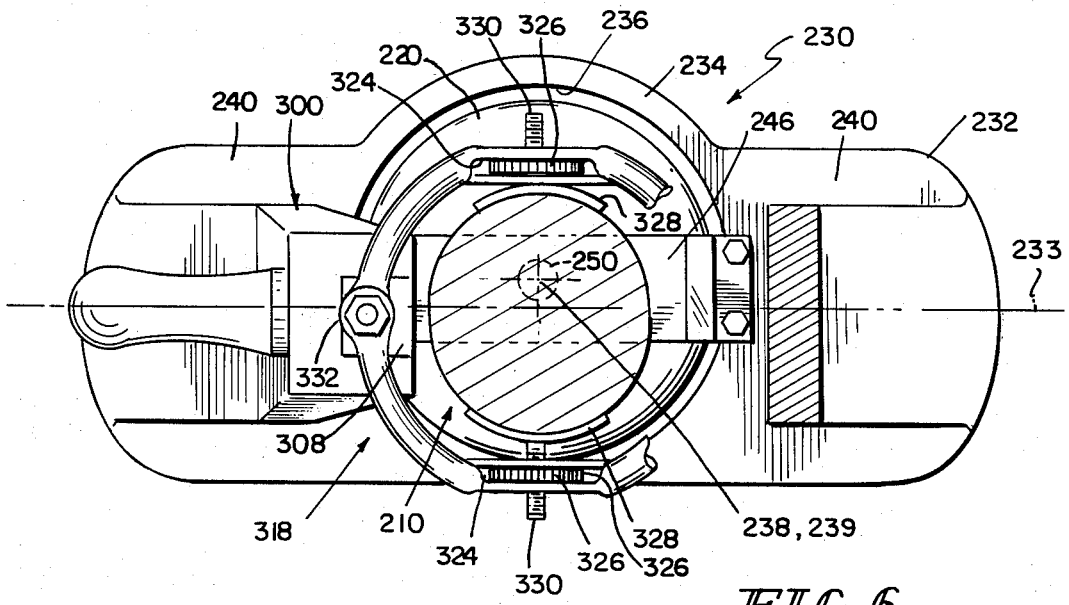
FIG. 6 is a top view, partly broken away and cross-sectioned, of the apparatus shown in FIG. 5, taken generally along the lines 6—6 in FIG. 5.

Referring to FIGS. 5 and 6, the apparatus 230 of the present invention is designed to support the portable tool 210 at generally a right angle to a work surface 224 (FIG. 5). The apparatus 230 includes an elongated, substantially planar base member 232 having a lower surface 242 and a central longitudinal axis 233. Base 232 may be constructed of wood, metal, or other rigid materials. The base member 232 includes a central section 234 having generally arcuate outer edges. A circular opening 236 is formed in the central section 234 and has a center 238 located on a central axis 239 of the opening 236. As best shown in FIG. 6, the central axis 239 of opening 236 is laterally located in spaced relationship to the longitudinal axis 233 of the base member 232. This relationship of the central axis 239 of the opening 236 and the longitudinal axis 233 of the base member 232 is provided to compensate for the offset position of the chuck 218 of the drill 210. In a preferred embodiment, the opening 236 has a diameter of 5.5 inches (13.97 cm) which will accommodate the pad of a standard sander attachment 220.

The base member 232 also includes two generally rectangular outer sections 240 which extend outwardly from the central section 234 in opposed directions. A bridge section 246 is elevated in spaced relationship above the opening 236. Bridge section 246 spans the opening 236 and includes a circular opening 250 which is concentric to opening 236. Opening 250 has a diameter which is generally less than the diameter of the opening 236, and provides a guide for the adapter 222 of the drill 210. The center of opening 250 is also located on the central axis 239 of the opening 236 in the base member 232.

Adapter 222 has a lower surface 223. A circular opening (not shown) in the center of lower surface 223 extends longitudinally upward and partially through adapter 222. Adapter 222 further includes threaded hole 225 extending transversely through one side of adapter 222 to intersect the longitudinally extending circular opening (not shown) at a right angle.

Sanding pad 220 has post 221 for being received into the longitudinally extending circular opening (not shown) of adapter 220. A set screw (not shown) is threadably received into threaded hole 225 and is tightened against post 221 to secure the sanding pad 220 to adapter 222.

Adapter 222 is selected so as to mate with the particular sanding pad 220 used. Every adapter 222 includes a standard $\frac{1}{4}$ inch post 226 for being fastenably received into chuck 218 in a manner well known.

Two support brackets 300 are mounted in opposed relationship on the base member adjacent opening 236. Each support bracket 300 has an upwardly facing, inwardly extending surface 302 and an outwardly facing, downwardly extending surface 304. Mounted on surface 304 of each support bracket 300 is a handle 306.

Each support bracket 300 has a post member 308 upwardly extending from the inner edge of surface 302. Each post member 308 has an outwardly extending flange 310. Each support bracket 300 further has a circular opening 312 downwardly extending from surface 302 and having a center on a post axis 314. Each flange 310 has a circular opening 316 extending through the flange coaxially with post axis 314.

The apparatus 230 further includes a clamping mechanism 318 for clamping drill 210 and a spring-fastening system 320 for fastening clamping mechanism 318 to support brackets 300. Clamping mechanism 318 includes a generally circular clamping bracket 322 having a diameter larger than the diameter of the cylindrical outer casing 212 of drill 210. Circular clamping bracket 318 further includes two elongated hole sections 324 opposably located in arcuate sections of clamping bracket 318, each elongated hole section 324 movably enclosing a thumbwheel 326. Each thumbwheel 326 has a threaded circular opening (not shown) extending transversely through its center.

Clamping mechanism 318 further includes two arcuate clamping pads 328 for clamping against the outer casing of drill 210. A radially outwardly extending threaded rod 330 is mounted to the center of each clamp 328.

Each threaded rod 330 extends through circular openings in clamping bracket 332 and is receivably engaged by threaded openings in thumbwheel 326. By rotating thumbwheel 326, the threaded rod 330 that is receivably engaged in the thumbwheel 326 is moved radially inward, thereby moving the clamping pad 328 mounted on the threaded rod 330 against outer casing 212 of drill 210, or radially outward, thereby moving clamping pad 328 away from casing 212. Since the two clamping pads 328 are opposably located, they act in conjunction with each other to fasten drill 210 to clamping mechanism 318.

Clamping bracket 318 further includes two opposably located, radially outwardly extending flanges 332. Each flange 332 is located on the periphery of an arcuate portion of clamping bracket 322 at an angle of approximately 90° from the nearest elongated hole section 324. Each flange 332 has a circular opening (not shown) extending downwardly through the flange.

Spring support system 320 includes two threaded rods 334, four nuts 336 and two nuts 337 for threadably fastening on threaded rods 334, and two helical springs 330. The diameters of helical springs 338, circular openings (not shown) in flanges 332, circular openings 312, and circular openings 316 are larger than the diameters of threaded rods 334.

Clamping mechanism 318 is mounted on support brackets 300 by spring support system 320. In the mounted position, one threaded rod 334 extends through the circular opening (not shown) in one of flanges 332, through circular opening 316 in one flange 310, and through circular opening 312 in one support bracket 300. One helical spring 338 is placed over threaded rod 334 between the lower surface of flange 310 and the upper surface 302 of support bracket 300. A nut 337 is fastened on threaded rod 334 between the lower edge of spring 338 and upper surface 302. One nut 336 is threaded on threaded rod 334 below flange 332 and another nut 336 is threaded on threaded rod 334 above flange 332. The nuts 336 above and below flange 332 are tightened against flange 332. Nuts 337 are threadably adjusted on threaded rods 334 and threaded rod 334 is threadably adjusted through nuts 336 so that sanding pad 220 extends generally below the lower surface 242 (FIG. 5) of base member 232 when springs 338 are in their normal relaxed position. In a preferred embodiment, sanding pad 220 extends ¼ inch to 3/16 inch below the lower surface 242 of base member 232.

To operate the apparatus, trigger switch 216 is closed, switching the drill 210 on. As the drill 210 rotates, adapter 222, which is rotated by drill chuck 218, rotates within circular opening 250 in bridge section 246. Circular opening 250 has a diameter slightly larger than the diameter of the adapter 222 rotating within it. Bridge section 246 thereby provides lateral locational support for adapter 222 as it rotates.

Since sanding pad 220 is fastened into adapter 222, it is rotated by drill 210. As sanding pad 220 is applied against working surface 224, the lower surface 242 of base member 230 will be some distance above working surface 224 as determined by the adjustment of spring support system 320 as discussed previously. Applying a downwardly directed force against handles 306 in the direction of arrows 340 forces base member 232 down toward the work surface 224. Since sanding pad 220 is already applied against work surface 224, drill 210 to which sanding pad 220 is fastened through adapter 222 and chuck 218 will remain stationary with respect to work surface 224 as will clamping mechanism 318.

Support brackets 300 will be moved downward along with the base 232. Flanges 310 will be moved downward toward nuts 337 along threaded rods 334 which are held stationary by nuts 336 fastening the rods 334 to flanges 332 of clamping bracket 322. Nuts 337, threadably fastened on rods 334, will also remain stationary. The downward movement of flanges 310 toward nuts 337 will compress helical springs 338, thereby transmitting the downwardly directed force applied against handles 306 to drill 210 so that sanding pad 220 is forced against work surface 224.

As the downward force applied against handles 306 is increased, the lower surface 242 of base member 232 eventually is moved downward so that it contacts work surface 224. Up to and including this point in time, the force applied against sanding pad 220 forcing it against work surface 224 is that which is developed by compressing helical springs 338.

Once the lower surface 242 of base member 232 contacts work surface 224, flange 310 of support brackets 300 can no longer be moved downward relative to nuts 337. Therefore, helical springs 338 cannot be further compressed. Since the force directed against sanding pad 220 is that which is developed by compressing helical springs 338, a greater amount of force cannot be applied by sanding pad 220 against work surface 224, irregardless of any increase in force applied to handles 306. Decreasing the downward force applied against handles 306 allows helical springs 338 to relax, thereby decreasing the force applied by sanding pad 220.

Figures 7, 8, 9, 10:
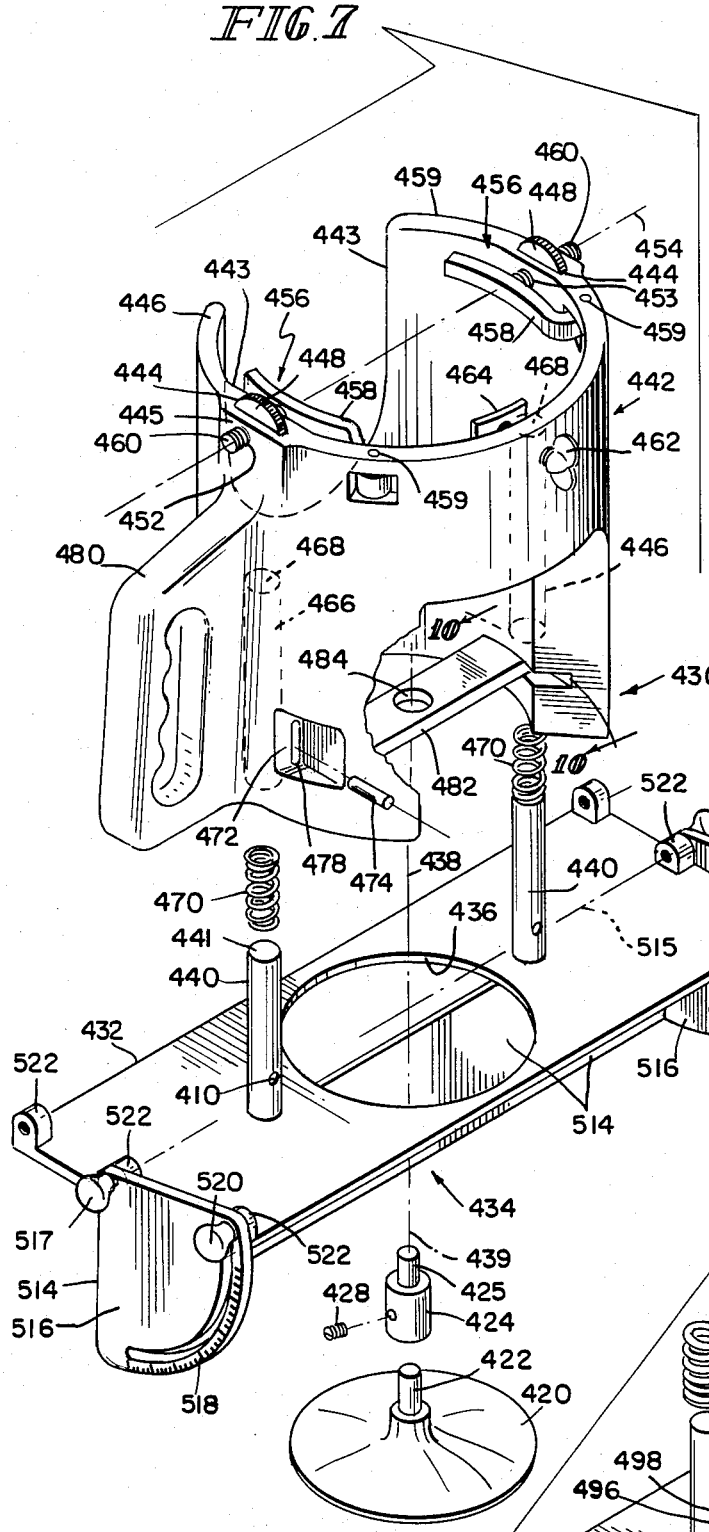
FIG. 7 is a perspective view of another embodiment of an apparatus according to the present invention.
FIG. 8 is a side elevational view, partly cross-sectioned, showing an alternative spring mount for the apparatus shown in FIG. 7.
FIG. 9 is a perspective view, partly cross-sectioned, showing an exploded view of a base and spring mounting of the apparatus shown in FIG. 7.
FIG. 10 is a sectional view taken generally along the line 10—10 in FIG. 7.

Referring now to FIG. 7, another illustrative embodiment of the apparatus as constructed in accordance with the present invention is shown. The apparatus 430 is designed to support the portable tool (not shown) at generally a right angle to a work surface (not shown). It should also be noted that the motor of the power-driven tool may be housed within the apparatus shown in FIG. 7. Thus, the apparatus in FIG. 7 may be a self-contained power-driven tool or be used to support a portable tool. In the illustrative embodiment, the apparatus is shown adapted for supporting a portable tool.

The apparatus 430 includes an elongated, substantially planar base member 432 having a central longitudinal axis 433. Base 432 may be constructed of wood, metal, or other rigid materials. The base member 432 includes a central section 434. A circular opening 436 is formed in the central section 434 and has a center 438 located on a central axis 439 of the opening 436. In a preferred embodiment, the opening 436 has a diameter of 5.5 inches (13.97 cm) which will accommodate the pad of a standard sander attachment 420.

Sander pad 420 includes post 422 for being receivably fastened in a longitudinally extending circular opening (not shown) in an adapter 424. Adapter 424 includes threaded cylindrical opening 426 for threadably receiving a set screw 428. Cylindrical opening 426 extends transversely through a wall of adapter 424 to intersect the longitudinally extending circular opening at a right angle. When post 422 of sander pad 420 is received into the longitudinally extending circular opening, set screw 428 is tightened against post 422 in threaded hole 426, thereby securing sander pad 420 to adapter 424.

Adapter 424 has a standard ¼ inch post 425 for being fastened into the chuck (not shown) of a drill (not shown) in a manner well known.

Base member 432 includes two mounting posts 440 extending upwardly from the base member 432 and located along the longitudinal axis 433 on opposite sides of opening 436. Each mounting post 440 has a transversely extending cylindrical hole 410 located above the base member 432 and an upper surface 441.

The apparatus 430 further includes a generally cylindrically shaped housing 442 having a larger diameter than the diameter of the drill casing. The rear portion of housing 442 includes an opening 443 adapted for receiving the handle of a portable drill supported within the housing 442. Opening 443 also provides access for insertion of the drill into housing 442. Housing 442 may include two elongated slots 444 opposably located in an upper surface 446 of housing 442 and extending axially downward. Elongated slots 444 are open along upper surface 446 of housing 442 and are enclosed by an inner wall 443 and an outer wall 445 of housing 442. Two thumbwheels 448 are movably located in the elongated slot 444. It will be appreciated that thumb screws could be used in place of the thumbwheels 448 without departing from the scope of the present invention.

Each thumbwheel 448 has a threaded hole (not shown) extending transversely through the center of the thumbwheel 448. Outer housing wall 445 includes cylindrical holes 452 transversely radially extending through outer wall 445 of housing 442 along a radial axis 454. Inner housing wall 443 includes cylindrical holes 453 transversely radially extending through inner wall 443 along radial axis 454. Radial axes 454 extend through the center of cylindrical holes 452 and 453 and through the center of the threaded hole in thumbwheels 448.

The apparatus further includes two clamping elements 456. Each clamping element has an arcuate clamping pad 458. Each clamping pad 458 is pivotally mounted to the housing 446 such as at points 459 to allow pivotal movement of the pads 458. A threaded rod 460 engages the center of arcuate clamping pad 458 and extends radially outward along radial axis 454. Threaded rod 460 extends through cylindrical hole 453 in the inner wall 443 of housing 442, threadably through the threaded hole in thumbwheel 448, and through cylindrical hole 452 in the outer wall 445 of housing 442. It will be appreciated that the position of slots 444 and thumbwheels 448 may be varied along upper surface 446 so that rods 460 either engage the clamping pads 458 at their centers or engage the pads 458 at a sufficient angle to cause the pads to exert a force on the curvature of the drill housing.

Rotating one of thumbwheels 448 will move the threaded rod 460 radially inwardly or outwardly, depending upon the direction the thumbwheel 448 is rotated. The corresponding arcuate clamping pad 458 will be pivotally moved radially inwardly or outwardly by the threaded rod 460. The drill, not shown, is clamped in housing 442 by the rotation of both thumbwheels 448 so that both arcuate clamping pads 458 are pivotally moved radially inwardly to contact the casing of the drill (not shown). The thumbwheels 448 are then used to tighten the arcuate clamping pads 458 against the casing of the drill.

Housing 442 further includes thumbscrew 462 transversely threadably extending through housing 442 generally near upper surface 446. Thumbscrew 462 extends radially inwardly at a right angle to radial axis 454. A locator pad 464 is secured to the radial inward end of thumbscrew 462. Rotating thumbscrew 462 moves it and locator pad 464 radially inwardly or outwardly according to the direction thumbscrew 462 is rotated. When the drill has been fastened in housing 442, thumbscrew 462 is rotated to move locator pad 464 radially inwardly to contact the casing of the drill to provide lateral support for the drill so that the sanding pad 420 coupled to the drill is held at a right angle to the base member 432.

Housing 442 further includes two cylindrical post holes 466. The diameters of the cylindrical post holes 466 are slightly greater than the diameters of mounting posts 440. Cylindrical post holes 466 are opposably formed in housing 442 and extend axially upward. The body of housing 442 forms stops 468 at the axial upper end of post holes 466. The distance between the centers of post holes 466 is the same as the distance between the centers of mounting posts 440 so that housing 442 can be placed onto base member 422 and the mounting posts 440 will extend axially upwardly into post holes 466.

The apparatus further includes two helical springs 470 being diameters somewhat smaller than the diameter of mounting posts 440. Springs 470 are placed in post holes 466 between stops 468 and the top surfaces 441 of mounting posts 440 when housing 442 is assembled onto base member 432. Since the diameter of springs 470 is less than the diameter of mounting posts 440, the springs 470 will be held between the stops 468 and the top surfaces 441 of mounting posts 440.

Housing 442 further includes elongated slots 472 tangentially extending through housing 442 at a right angle to post holes 466 generally toward the lower edge of housing 442. The widths of elongated slots 472 are slightly larger than the diameters of cylindrical holes 410 in mounting posts 440. Housing 442 forms upper limiting surface 476 at the top edges of elongated slots 472 and lower limiting surfaces 478 at the lower edge of elongated slots 472.

The apparatus further includes cylindrical pins 474 for movably securing housing 442 to the base member 432. The diameters of cylindrical pins 474 are slightly smaller than the diameters of cylindrical holes 410.

When housing 442 is mounted on base member 432, cylindrical pins 474 are inserted through elongated slots 472 into cylindrical holes 470 in mounting posts 440 and are fastened in a conventional manner. An outer portion of cylindrical pins 474 will continue to extend through elongated slots 472 after pins 410 have been fastened in place.

Holes 410 will have been located on posts 440 so that springs 470 will be relaxed or just slightly compressed when no downward force is applied to housing 442 and the lower limiting surfaces 478 will be generally adjacent or lightly forced against pins 474. Further, in this normal state, the lower edge of the housing 442 will be a distance above the top surface of base member 432, thereby holding sanding pad 420 next to or a distance slightly above the work surface (not shown). In a preferred embodiment, the lower edge of housing 442 is ⅜ inch above the top surface of base member 432, and sanding pad (when mounted) will be in the same plane as or slightly above base member 432.

Housing 442 further includes bridge section 482 having a circular opening 484 formed in the center of bridge section 482. Circular opening 484 has a diameter slightly larger than the diameter of adapter 424 and is concentric with circular opening 436 in base member 432 when housing 442 is mounted on base member 432. When the apparatus is in operation, adapter 424 will always extend through circular opening 484 in bridge section 482 so that bridge section 482 will provide lateral support for sanding pad 420 as it is rotated by the drill.

When the drill is clamped in housing 442 and sanding pad 420 is coupled to the drill through adapter 424, sanding pad 420 will be adjacent to or slightly above the work surface and the lower edge of housing 442 will be ⅜ inch above the top edge of base member 432 until pressure is applied to sanding pad 420 and then the distance between will become slightly less. Housing 442 further includes opposed handles 480. The application of a downward force on handles 480 will force the housing 442 downward with respect to base member 432. Stops 468 will be forced downward relative to top surfaces 441 of mounting post 440, thereby compressing springs 470.

Since base 432 will be resting against the work surface, sanding pad 420 will be moved toward the work surface. When sanding pad 420 contacts the work surface, the lower edge of housing 442 will still be some distance above the top surface of base member 432, permitting the full force exerted on handles 480 to be applied to the sanding pad 420, forcing it against the work surface. The lengths of post holes 466 are sufficiently longer than the ength of posts 440 so that springs 470 will not be completely compressed when sanding pad 420 contacts the working surface.

Referring to FIG. 8, a modification of the mounting arrangement just discussed is shown.

Housing 442 includes mating half 486 having mating surfaces 487 and mating half 488 having mating surfaces 489. Mating halves 486 and 488 form housing 442 when they are mated together. Mating surfaces 487 and 489 form post holes 466 when mating halves 486 and 488 are brought together.

Each mating half 486, 488 further includes semicylindrical cavities 492. The semicylindrical cavities 492 in mating half 486 combine with the semicylindrical cavities 490 in mating half 488 to form two cylindrical cavities (not shown). One cylindrical cavity is located about each post hole 466 generally towards the lower edge of housing 442.

Mounting posts 440 further include disks 494 securely fastened to the mounting posts 440 at about the same location as cylindrical holes 410 in FIG. 7. The diameters of the cylindrical cavities formed by combining semicylindrical cavities 492 are slightly larger than the diameters of disks 494. The axial length of the cylindrical cavities is generally the same as the length of elongated slots 472. Springs 470 are interposed in post holes 466 between stops 468 and top surfaces 441 as described previously.

Disks 494 are enclosed in the cylindrical cavities when the housing 442 is assembled by mating the halves 486 and 488. Disks 494 operate in conjunction with the cylindrical cavities in the same manner that cylindrical pins 474 (FIG. 7) held in cylindrical holes 410 (FIG. 7) operated with elongated slots 472.

Referring now to FIG. 9, a third mounting arrangement is shown. Mounting posts 440 include elongated slots 496, upper limiting surfaces 498 at the top edges of elongated slots 496, and lower limiting surfaces 500 at the bottom edges of elongated slots 496.

Housing 442 includes large post holes 502, axially extending a limited distance up through housing 442, and small post holes 504 extending axially upward from the top edge of large post holes 502. Further included are helical springs 506 having a diameter larger than mounting posts 440 but smaller than the diameter of large post holes 502. The diameter of small post holes 504 is larger than the diameter of mounting posts 440 but smaller than the diameter of helical springs 506. The intersection of the bottom edge of small post holes 504 with the top edge of large post holes 502 forms shoulder stops 508.

Housing 442 further includes cylindrical holes 510 transversely extending through housing 442 and intersecting small post holes 504 at a right angle slightly above shoulder stops 508 and cylindrical holes 512 partially transversely extending through housing 442 and intersecting small post holes 504 at a right angle at the same location on the opposite side of small post hole 504 that cylindrical hole 510 intersects small post hole 504.

When housing 442 is assembled on base member 432, mounting posts 440 extend axially upward through large post holes 502 and small post holes 504. Helical springs 506 are interposed between shoulder stops 508 and the top surface of base member 432 around mounting post 440. Cylindrical pins 474 are extended through elongated slots 496 so that a portion of cylindrical pin 474 extends from one side of elongated slots 496 into cylindrical hole 512, and a portion of cylindrical pin 474 extends from the opposing side of elongted slots 496 into cylindrical hole 510. Pin 474 is fastenably secured in place by any conventional means.

In the normal position, helical springs 506 push against shoulder stops 508, pushing housing 442 upward until cylindrical pin 474 contacts upper surface 498 in mounting post 440, thereby preventing any further upward movement. In this position, sanding pad 420, as described with reference to the embodiment in FIG. 7, is held adjacent to or slightly above, working surface upon which base member 432 is resting and the lower edge of housing 442 is held a greater distance above the top surface of base member 432. The application of a downward force on handles 480 (FIG. 7) causes the apparatus in FIG. 9 to act in the same manner as described with respect to FIG. 7 except for the differences just discussed.

Referring now to FIG. 7, base member 432 further includes angular edge bracket 514 extending downward from and longitudinally along the longitudinal axis 515 of base member 432. Angular edge bracket 514 is pivotally mounted to base member 432 and includes plates providing adjusting mechanisms 516 extending downward from base member 432 at right angles to the end of bracket 514. The plates 516 are pivotally mounted to base member 432 by thumbscrews 517, and each plate 516 includes an arcuate slot 518. A thumbscrew 520 fastens plate 516 to base member 432. Thumbscrew 520 passes through arcuate slot 518, and when loosened, permits bracket 514 to be angularly adjusted with respect to base member 432 prior to tightening thumbscrew 520. Inserts 522 for thumbscrews 520 are provided on axis 515 and at both edges of the base member 432 so that angular edge bracket 514 can be mounted with its face either to the back or to the front of the apparatus 430. Further, slot 520 is elongated to provide for acute angles between the bracket 514 and the base member 432 of as little as 30°.

Referring to FIG. 9, the base member 432 is shown with a vertical face plate 524. Vertical plate 524 is fixably fastened to an edge of base member 432 at a 90° angle. Resting the vertical plate 524 against a floor provides support to the apparatus as an adjacent wall is being sanded. Plate 524 also adds strength to the base member 432.

Continuing to refer to FIG. 9 in the illustrative embodiment, the intersection of base member 432 and vertical face plate 524 provides a central elongated slot 526. The circular opening 436 in base member 432 extends through the edge of base member 432 to form the slot 526. Slot 526 permits the sanding pad to rotate without rubbing against the vertical face plate 524. An apparatus constructed in this manner permits the working surface to be sanded near its intersection with an adjacent 90° surface.

It will be appreciated that many of the features described in the embodiments of my invention shown in FIGS. 5–10 may also be included in the embodiments shown in FIGS. 1–4. For instance, the spring-biasing feature shown in FIGS. 5 and 6 is adaptable to the apparatus shown in FIGS. 1–4 with only slight modification. Furthermore, the angle bracket features shown in FIGS. 7 and 9 could be added to the embodiments shown in FIGS. 1–6. Various other combinations of features shown in FIGS. 5–10 may also be used without departing from the scope of my invention.

What is claimed is:

1. An apparatus for supporting a portable rotary tool for use as a rotary sander, the tool having a chuck adapted to receive a sanding pad, the apparatus comprising a base member having a longitudinal axis, the base member providing an opening having a central axis at generally a right angle to the base member, clamping means for engaging and supporting the rotary tool on the base member so the sanding pad is received in the opening, and resilient means for biasing the clamping means with respect to the base member whereby the sanding pad is forced against a work surface through the opening in the base member.

2. The apparatus of claim 1 wherein the base member includes handle means for use by an operator in holding and manipulating the apparatus and the resilient means includes spring means yieldably biasing the clamping means toward the base member normally to urge the sanding pad through the opening beyond the base member.

3. The apparatus of claim 2 wherein the base member includes support brackets providing the handle means, the support brackets also providing means for retaining the spring means between the clamping means and the base member wherey exertion of force by the operator on the handle means urges base member toward the work surface against the bias of the spring means.

4. The apparatus of claim 1 wherein the clamping means includes handle means for use by an operator in holding and manipulating the apparatus and the resilient means includes spring means yieldably biasing the clamping means away from the base member normally to retract the sanding pad but to allow exertion of force by the operator on the handle means to urge the sanding pad through the opening beyond the base member.

5. The apparatus of claim 4 wherein the base member includes support means for supporting the clamping means, the support means providing means for retaining the spring means between the clamping means and the base member normally to bias the clamping means away from the base member.

6. The apparatus of claim 1 further comprising face plate means extending transversely to the base member for guiding the sanding pad with respect to a surface adjacent to the work surface.

7. The apparatus of claim 6 wherein the face plate is fixedly attached to an edge of the base member and extends upwardly from the base member at approximately 90° thereto.

8. The apparatus of claim 6 further comprising adjustment means for providing variable angular relationships between the face plate means and the base member.

* * * * *